US005228672A

United States Patent [19]

Pane

[11] Patent Number: 5,228,672

[45] Date of Patent: Jul. 20, 1993

[54] DEVICE FOR AUTOMATICALLY INTRODUCING PAPER RIBBONS INTO AN ANGLE-BAR

[75] Inventor: Mario Pane, I-Trino Vercellese, Italy

[73] Assignee: Officine Meccaniche Giovanni Cerutti, S.p.A., Italy

[21] Appl. No.: 675,773

[22] Filed: Mar. 27, 1991

[30] Foreign Application Priority Data

Mar. 28, 1990 [IT] Italy ..... 19851 A/90

[51] Int. Cl.[5] ..... B65H 5/02

[52] U.S. Cl. ..... 271/9; 271/277; 226/92; 226/197

[58] Field of Search ..... 226/91, 92, 197; 271/9, 271/277

[56] References Cited

U.S. PATENT DOCUMENTS

| | | | |
|---|---|---|---|
| 2,862,705 | 12/1958 | Faeber | 226/92 |
| 4,070,965 | 1/1978 | Aenishaenslin | 226/92 X |
| 4,111,122 | 9/1978 | Kutzner | 226/92 X |
| 4,187,968 | 2/1980 | Winterholler | 226/92 |

*Primary Examiner*—Richard A. Schacher

*Attorney, Agent, or Firm*—Kirschstein, Ottinger, Israel & Schiffmiller

[57] ABSTRACT

Arrangement for automatically introducing paper ribbons into a plurality of angle-bars of a printing press, comprising a plurality of endless chains, one for each angle-bar, for conveying a respective ribbon to a folder-stitcher unit. Each chain has a gripper for grasping a leading end of the respective ribbon. Each chain is independently driven by a motor drive.

9 Claims, 4 Drawing Sheets

DEVICE FOR AUTOMATICALLY INTRODUCING PAPER RIBBONS INTO AN ANGLE-BAR

BACKGROUND OF THE INVENTION

1. Field of the Invention

The present invention relates to a device for the automatic introduction of paper ribbons into an angle-bar unit arranged between a cutting group and a folding/-stitching group of a printing press.

2. Description of Related Art

It is known to experts in the field that, after the cutting device which divides the web of paper (printed, for example, in a rotary press) into individual ribbons and before the folder/stitcher which is provided downstream of the rotary press, there are provided so-called angle-bar units. These angle-bar units consist essentially of cylinders which are orientable and positionable for the purpose of being able to vary, after the cutter, the direction of advance of the individual ribbons as well as their mutual succession, in order to have available before the folder/stitcher multiple ribbons, arranged parallel and in the desired order.

It is also known to experts in the field that the introduction of the individual paper ribbons (previously cut) requires considerable time and labor, given that each ribbon, in addition to being arranged around the relative cylinder of the angle-bar group, also has to be arranged around a series of cylinders for return and for compensation, which are indispensable for guiding each individual ribbon to the folder/stitcher with precision and safety.

It is easy to understand that every break of the paper and thus every new phase of introduction of the paper ribbon into the angle-bar unit has an unfavorable influence on the production costs as a result of the manual operations required.

SUMMARY OF THE INVENTION

The aim of the present invention is to overcome the disadvantages associated with the prior state of the art and to propose a device, by means of which the paper ribbons, from the cutting device to the folder/stitcher, can be introduced automatically into the angle-bar unit.

According to the present invention, this aim is achieved by virtue of the fact that there is combined with each angle-bar device a chain, cable or similar means of traction forming a closed ring, which covers in part the trajectory of the corresponding paper ribbon from the cutter to the folder/stitcher, and that each chain or cable is connected to controllable motorization means, and moreover that it has means for grasping the edge of the paper ribbon to be introduced.

Using a device of this type, it becomes possible to introduce the various ribbons into the angle-bar unit in an automatic manner. This operation can be effected using one single operator who has only to grasp the individual ribbons and connect these to the locking means of the individual chains or cables in order by means of their advance to introduce said ribbons between the corresponding angle-bar groups.

BRIEF DESCRIPTION OF THE DRAWINGS

The article, designed according to the present invention, will now be described in greater detail and illustrated by means of an embodiment given solely by way of example in the attached drawings, in which.

DETAILED DESCRIPTION OF THE PREFERRED EMBODIMENT

Figure 1:
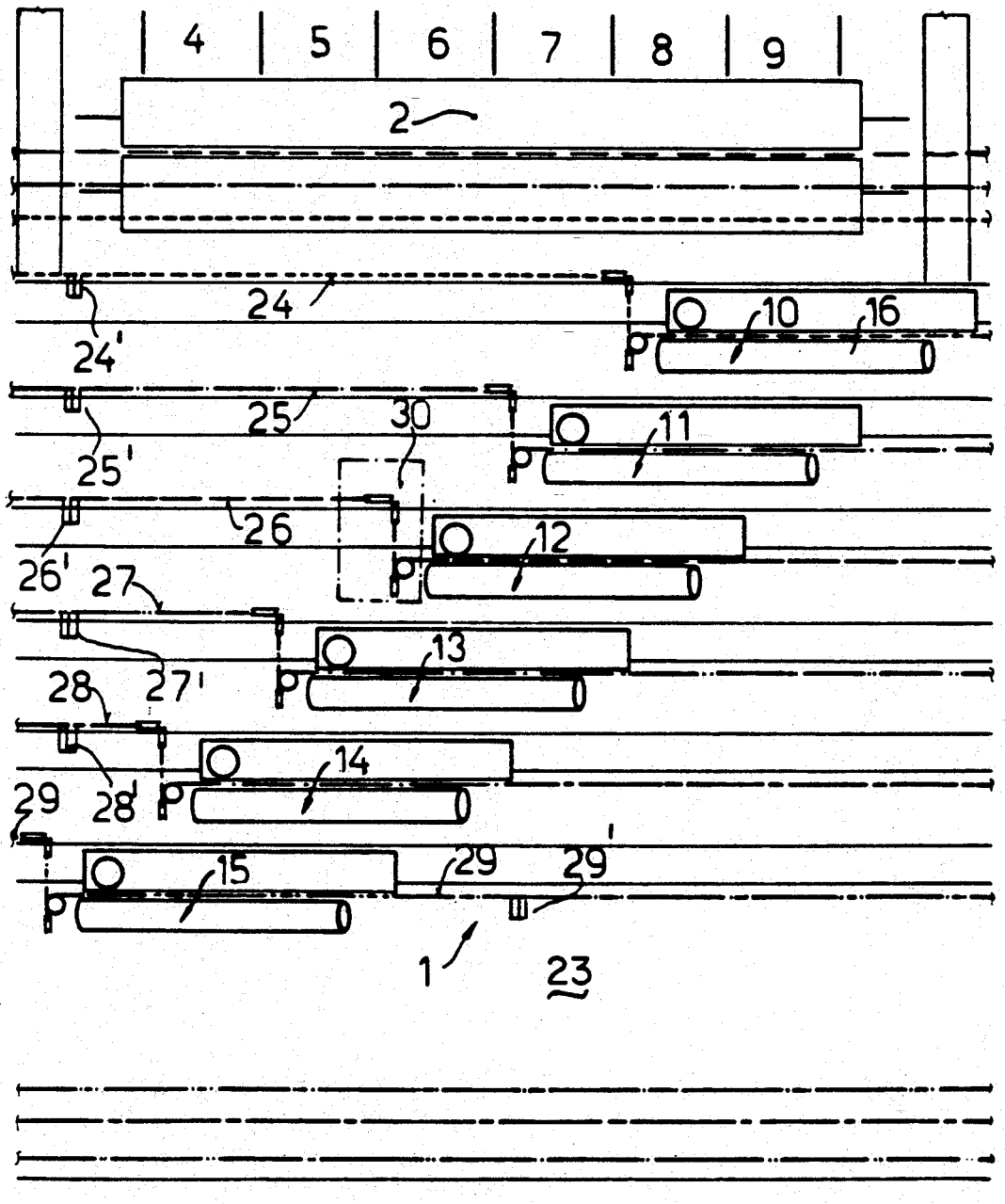
FIG. 1 shows the central part of an angle-bar group, equipped with feed means designed according to the present invention.

As can be seen from FIG. 1, the angle-bar group indicated as a whole by 1 is arranged between a known cutting device 2 and a known folder stitcher 23, not illustrated in detail.

By means of the cutting device 2, the printed web is cut into individual parallel ribbons, the number of which can vary. The ribbons are indicated by 4, 5, 6, 7, 8 and 9. Following the cutting device 2, there is provided for each cut ribbon an angle-bar group 10, 11, 12, 13, 14 and 15 respectively. In known manner, each angle-bar group (10–15) consists of a positionable cylinder (for example 16 for the group 10). With the aid of these positionable cylinders, it becomes possible to vary the direction of advance of the ribbons, diverting these, for example, in the horizontal direction toward the right or in the horizontal direction toward the left. The ribbons 4–9, after the angle-bar groups 10–15, are guided around cylinders for compensation which are indicated as a whole by 17, 18, 19, 20, 21 and 22. These cylinders for return and for compensation have the task of guiding the corresponding paper ribbon in a controlled manner through the entire angle-bar unit, in order to make it possible to convey in the end all the ribbons positioned tidily and arranged parallel to one another to the folder/stitcher 23.

Between the cutting group 2 and the folder/stitcher 23, there are subject to each angle-bar group further cylinders for compensation and for return, cylinders which are usual in an angle-bar unit. It will therefore not be necessary to describe these means further.

While the cutting device 2 is usually provided upstream of the angle-bar unit 1, a folder/stitcher 23, not illustrated in detail, is provided downstream of the angle-bar unit 1.

In order to be able automatically to introduce the paper ribbons 4–9 into the angle-bar unit 1, arranging the ribbons automatically around the corresponding cylinders 10–15 of the angle-bar groups, as well as around the relative cylinders 17–22 for compensation and around the cylinders for return and for compensation (usual and not indicated by numerical references), it is envisaged according to the invention that the path or the trajectory to be followed by the ribbons 4–9 inside the angle-bar units 10, 11, 12, 13, 14, 15 be covered by individual traction chains or cables.

These means of traction 24, 25, 26, 27, 28, 29 are indicated diagrammatically in the figures by means of differently dashed lines.

The chains or cables (24–29) each form a closed ring. In the figures attached hereto, the angle-bar unit 1 comprises a first cable ring 24 followed by a cable ring 25 which is followed by a cable ring 26 and, following this, a cable ring 27, a cable ring 28 and a cable ring 29. Each cable (24–29) extends in the form of a closed ring from a zone provided after the cutting group 2 to a zone in front of the folder/stitcher 23.

Given that the principle of the means of traction 24–29 arranged in the manner of a closed ring is repeated in an identical manner for each individual angle-bar group 10–15, only the path of the cable 26 will be described below.

Figure 2:
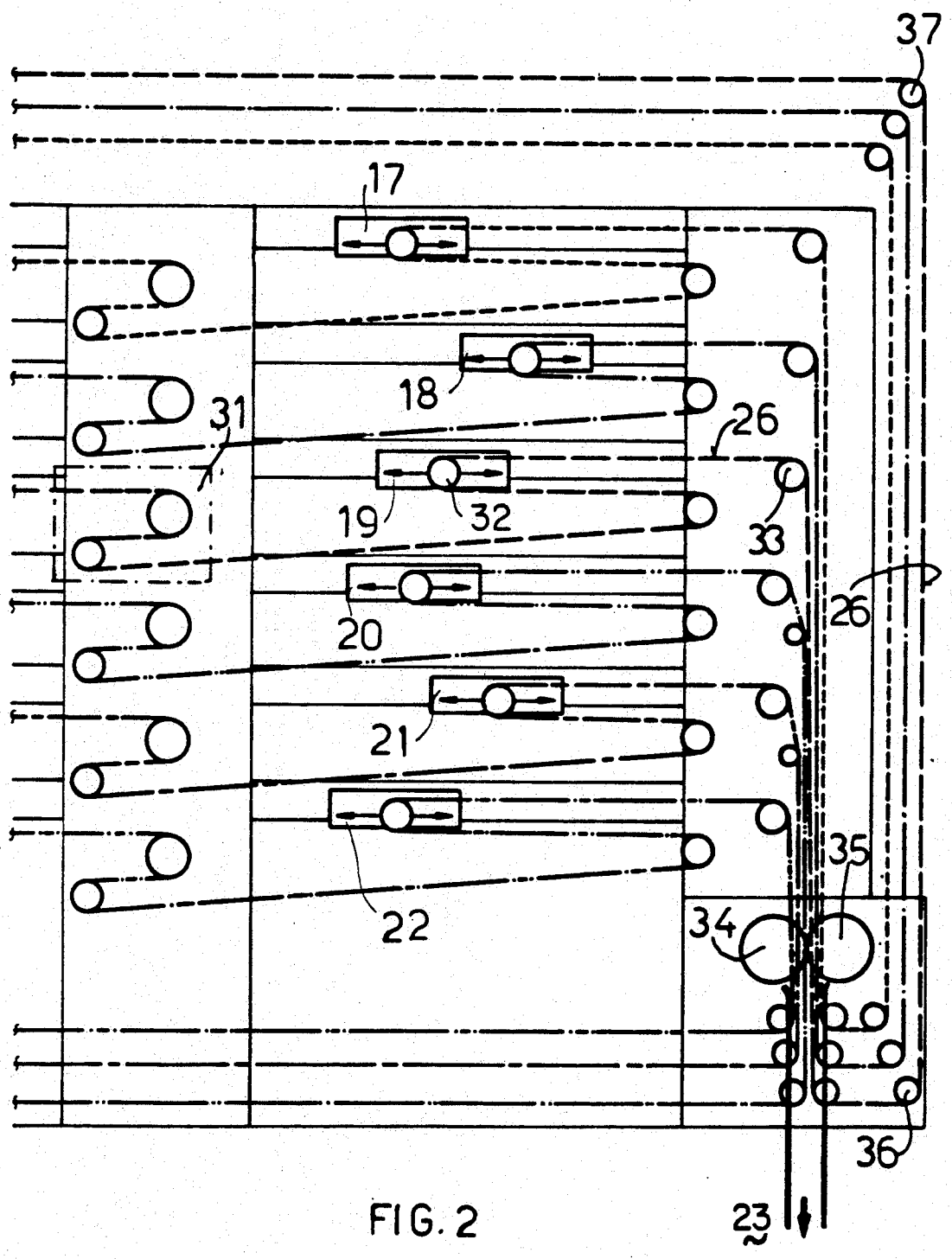
FIG. 2 shows the right-hand part of the angle-bar group with the folding unit.
Figure 3:
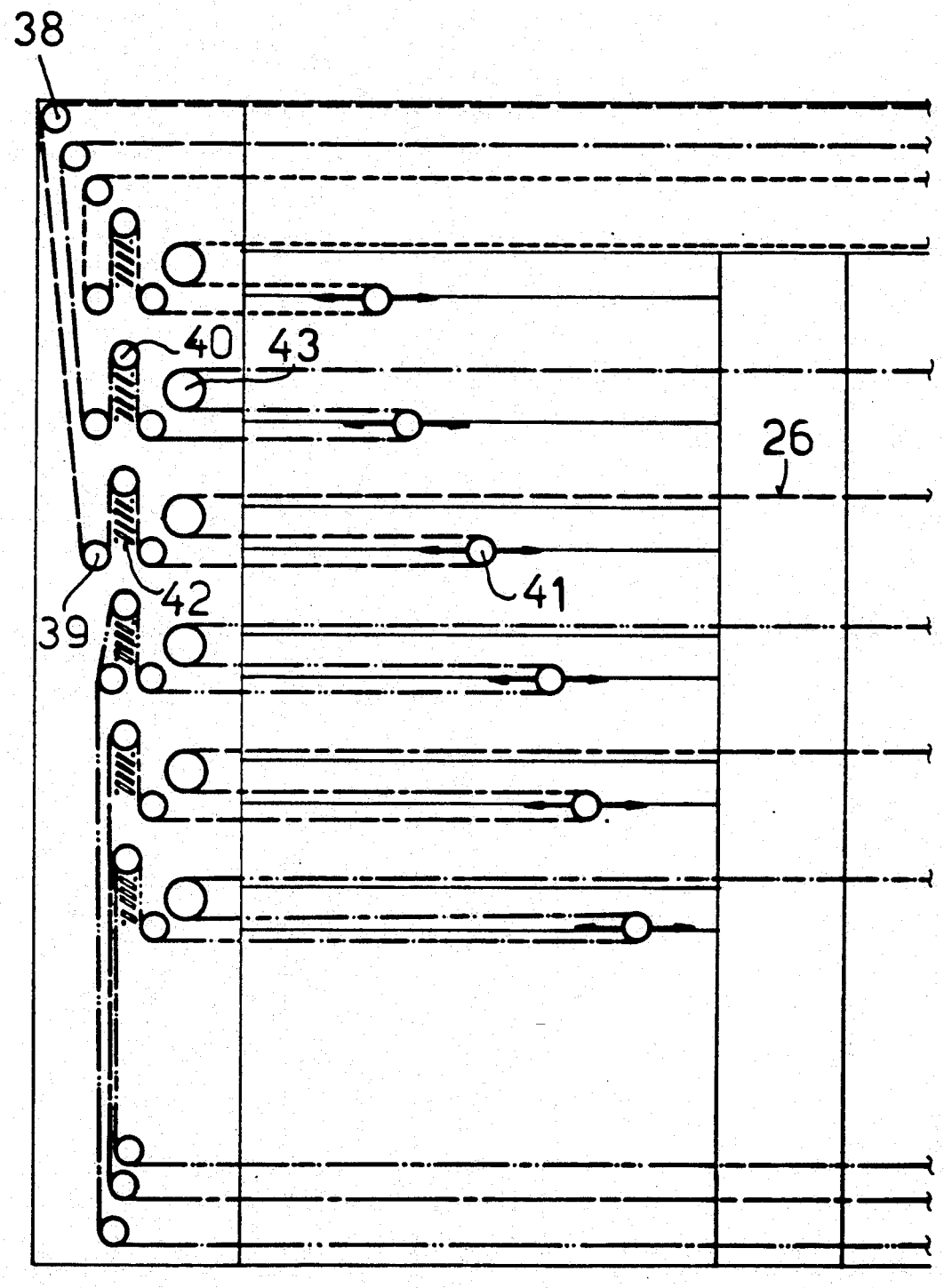
FIG. 3 shows the left-hand part of the angle-bar group with the rollers and cylinders for compensation and for return.

As can be seen from FIGS. 1, 2 and 3, the cable or chain 26 is arranged so as to form a closed ring, which follows the entire path of the corresponding paper ribbon from the cutter 2 to the folder 23. In the vicinity of the angle-bar group 12, the cable 26 is guided with the aid of groove wheels, indicated as a whole by 30. The cable 26 continues toward the right, being guided by a group of return wheels indicated by 31, still continuing toward the right-hand side of the angle-bar unit. As can be seen from FIG. 2, the cable 26 is guided by means of a groove wheel 32 provided on the compensation unit 19, to reach, after having passed a groove wheel 33, the zone of the folder/stitcher 23.

Subsequently, with the aid of feed rollers 34 and 35 and by means of return wheels 36, the cable 26 is conveyed on the external side of the angle-bar unit toward the top and, after having passed a further return wheel 37, crosses in the horizontal direction the upper zone of the angle-bar unit, to reach the left-hand side of the angle-bar unit (FIG. 3). After having passed the return wheels 38 and 39 and a wheel 40 and a series of compensation wheels 41, the cable 26 arrives once again at the group of return wheels 30. By means of this closed circuit, determined by the wheels for return and for compensation 30–41, it becomes possible to cover with the cable 26 the entire path of the paper ribbon through the angle-bar unit 1, that is to say from the cutter 2 to the folder/stitcher 23.

Particularly advantageously, it is envisaged, for example, that the return wheel 40 is supported with the interposition of a spring means 42 (or pneumatic cylinder) which functions as a damper and compensator for the traction cable or chain 26. In order to impart to the cable or chain 26 a movement in the desired direction and at the required speed, it is advantageous to operate the chain 26 using a motor which is controllable, for example, by means of the return wheel 43. Other motorization solutions can of course also be envisaged. As far as the operation of the chain is concerned, the most realistic solution is that of mechanically connecting the whole to the system of movement of the web threading of the rotary press, providing the possibility of an independent control.

In order optimally to exploit the space available for the installation of the means of traction 24, 25, 26, 27, 28 and 29, it is envisaged that, in the region of the feed cylinders 34, 35 of the folder/stitcher, half the traction cables, that is to say 24, 25 and 26, are diverted toward the right and toward the top part of the angle-bar unit 1, while the cables 27, 28 and 29 are diverted toward the left-hand part, that is to say the bottom part of the angle-bar unit.

Each cable 24, 25, 26, 27, 28 and 29 is equipped with a series of gripper means 24', 25', 26', 27', 28' and 29' which make it possible to grip the end of the paper ribbons 4, 5, 6, 7, 8 and 9 which are to be introduced automatically into the angle-bar unit 1, that is to say transporting the ribbons 4–9 from the cutting group 2 to the folding/stitching group 23.

Clearly, in order to bring about disengagement between said gripping means (not illustrated) and the ribbons 4–9, after the conveying rollers 34, 35, a means which makes it possible to open the grippers is to be provided. This device could consist, for example, of a cam or of a sliding block which acts on the movable part of the grippers in the direction of opening of the latter, releasing the paper.

Figure 4:
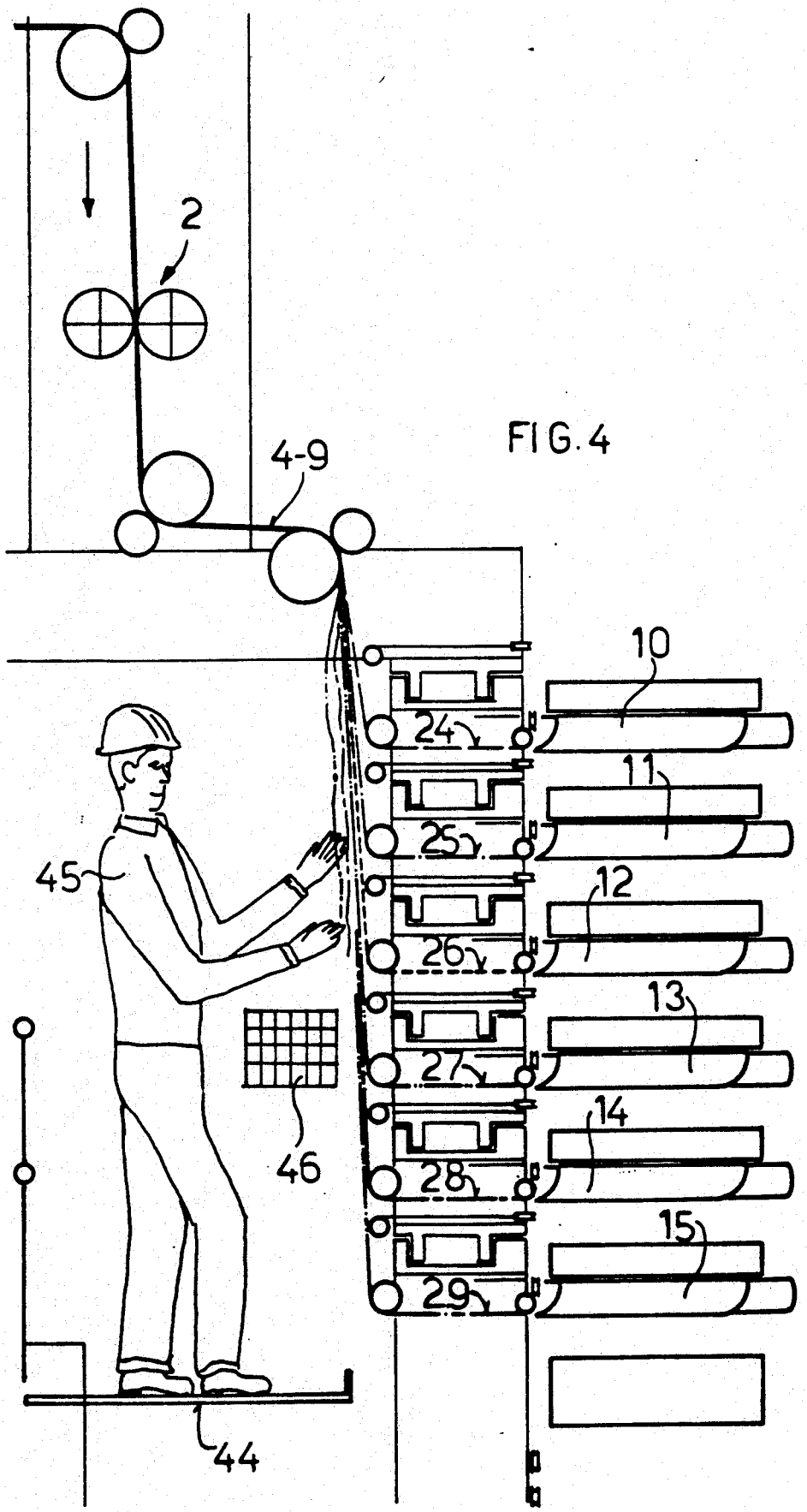
FIG. 4 shows in a lateral view the angle-bar group.

From FIG. 4, it can be seen that, below the cutting group 2, there is provided a platform 44 arranged in front of the individual angle-bar groups 10, 11, 12, 13, 14 and 15. The platform 44 permits access by an operator 45 who takes care of the introduction of the individual sheets 4–9 into the angle-bar unit 1 to the folder/stitcher 23 in the following manner:

by moving, by means of a control panel 46, the individual chain rings 24, 25, 26, 27, 28 and 29, it is possible to connect one end of the corresponding previously cut ribbons 4–9 to the chains 24–29, that is to say to the relative gripper means 24'–29'. By operating the motorization means of the individual chains or cables 24–29, the paper ribbons 4–9 are introduced automatically into the angle-bar unit 1, that is to say each ribbon is drawn automatically from the zone of the cutter 2 to the zone of the folder/stitcher 23.

In the above description, the guide wheels and return wheels for the traction cables have not been described in detail, given that an expert in the field will have no difficulty in mounting these guide wheels in the most suitable place inside the angle-bar unit 1.

Using the article according to the invention, the time for introduction of the ribbons 4–9 into the angle-bar unit is considerably reduced and moreover the operations for introduction of the ribbons can be carried out by one single operator.

I claim:

1. In a printing press including (A) a cutter operative for cutting a paper web into a plurality of individual cut strips, (B) an angle-bar assembly having a plurality of angle-bar units, and operative for arranging the cut strips in a desired pattern, and (C) a folder-stitcher operative for folding and stitching the arranged strips, a transport arrangement for conveying the cut strips through the angle-bar units to the folder-stitcher, the arrangement comprising:

(a) a plurality of endless driven conveyors, one conveyor for each cut strip and each angle-bar unit, each conveyor extending through a respective angle-bar unit and to the folder-stitcher;

(b) a gripper mounted on, and jointly movable with, each conveyor, and operative for gripping a leading end of each cut strip; and (c) control means for independently driving each conveyor to automatically transport each cut strip gripped by a respective gripper to and through each angle-bar unit to the folder-stitcher.

2. The transport arrangement of claim 1, wherein each conveyor is a chain.

3. The transport arrangement of claim 1, wherein each conveyor is a cable.

4. The transport arrangement of claim 1, wherein each conveyor is entrained by a series of guide rollers.

5. The transport arrangement of claim 4, wherein at least one of the guide rollers is resiliently mounted on a damping element.

6. The transport arrangement of claim 4, wherein each conveyor is entrained by a set of tension rollers.

7. The transport arrangement of claim 1, wherein the conveyors are mirror-symmetrically arranged relative to one another.

8. The transport arrangement of claim 1; and further comprising an access platform adjacent the conveyors, for supporting a human operator to feed each cut strip to a respective gripper.

9. The transport arrangement of claim 8, wherein the control means includes a set of motors operated by a control panel located at the platform.

* * * * *